US009342941B2

(12) United States Patent
Zander et al.

(10) Patent No.: US 9,342,941 B2
(45) **Date of Patent: *May 17, 2016**

(54) DEVICE FOR THE ACCEPTANCE OF COINS

(71) Applicants: Marco Zander, Kiel (DE); Roland Mührenberg, Lübeck (DE); Danis Shageev, Bad Oldesloe (DE)

(72) Inventors: Marco Zander, Kiel (DE); Roland Mührenberg, Lübeck (DE); Danis Shageev, Bad Oldesloe (DE)

(73) Assignee: Novomatic AG, Gumpoldskirchen (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/673,868

(22) Filed: Mar. 30, 2015

(65) Prior Publication Data

US 2015/0262447 A1 Sep. 17, 2015

Related U.S. Application Data

(63) Continuation of application No. 14/170,582, filed on Feb. 1, 2014, now abandoned, which is a continuation of application No. 13/388,960, filed as application No. PCT/IB2010/001940 on Aug. 4, 2010, now Pat. No. 8,640,850.

(30) Foreign Application Priority Data

Aug. 5, 2009 (DE) ..... 20 2009 010 573 U
Nov. 20, 2009 (DE) ..... 20 2009 015 900 U

(51) Int. Cl.

| | |
|---|---|
| ***G07F 1/04*** | (2006.01) |
| ***G07D 11/00*** | (2006.01) |
| ***G07F 1/02*** | (2006.01) |
| ***G07F 9/06*** | (2006.01) |
| ***G07G 1/00*** | (2006.01) |

(52) U.S. Cl.

CPC ..... *G07D 11/0018* (2013.01); *G07F 1/02* (2013.01); *G07F 1/045* (2013.01); *G07F 1/046* (2013.01); *G07F 9/06* (2013.01); *G07G 1/0027* (2013.01)

(58) Field of Classification Search

CPC ..... G07D 11/0003; G07D 11/0018; G07D 11/009; G07D 11/0093; G07F 1/02; G07F 1/04; G07F 1/045

USPC ..... 194/344, 345, 346, 347, 350; 232/1 D, 232/4 D, 4 R, 55, 57, 58, 60, 64, 65

See application file for complete search history.

(56) References Cited

U.S. PATENT DOCUMENTS 2,323,221 A * 6/1943 Hockey ..... A45C 1/12 232/4 D
2,465,431 A * 3/1949 Cisenfeld ..... A47B 88/00 232/4 D

* cited by examiner

*Primary Examiner* — Mark Beauchaine
(74) *Attorney, Agent, or Firm* — Kevin H. Fortin

(57) ABSTRACT

A device for the acceptance of coins which allows the acceptance of individual coins as well as the acceptance of various coins for further processing of the coins, whereby the device includes a laterally moveable holding fixture. The holding fixture has both a side with a coin insertion slot, and a receptacle area for the reception of a plurality of coins.

14 Claims, 3 Drawing Sheets

DEVICE FOR THE ACCEPTANCE OF COINS

CROSS-REFERENCE TO RELATED APPLICATIONS

This patent application is a continuation of pending U.S. patent application Ser. No. 14/170,582, filed on 1 Feb. 2014, which is a continuation of U.S. patent application Ser. No. 13/388,960, filed 3 Feb. 2012, now issued as U.S. Pat. No. 8,640,850 on 4 Feb. 2014, which claims priority under 35 USC 371 to International Application No. PCT/IB2010/001940, filed 4 Aug. 2010, which claims foreign priority to both German Patent Application No. 202009010573.3, filed 5 Aug. 2009 and German Patent Application 202009015900.0, filed 20 Nov. 2009. The disclosures of each of these related patent applications are incorporated herein by reference.

FIELD OF THE INVENTION

The invention refers to devices for accepting and processing coins.

BACKGROUND

For the processing of large coin quantities there are currently different insertion systems for devices for the processing of coins, such as, for example, coin counting devices and/or coin acceptance devices or similar. Some of these devices are operated with a coin flap, which when opening and folding have an insertion cup on the back side, which collects the coins and which conveys these to the device downwards when folding back.

The US 2004/0011620 A1 is a coin device whereby the coin is placed into a tiltable slot in order to process it there. The coins are deposited there and with the tilting of the slot they are fed in for further processing.

With other familiar devices the coins are inserted individually through a coin slot in the device, which is not easily operable with big quantities of coins.

With other solutions, for example, more coins can be fed into the device than can flow out or can be processed. This results in a congestion of the coins which makes the acceptance process difficult.

Often the usual realisations have an extra insertion slot for individual coins at a different part of the device or they have no slot for individual insertion of coins. If there is no slot for individual insertion, then by using the receptacle of large coin quantities the insertion of individual coins is made more difficult, so the insertion through the coin slot is quick and straightforward.

Also, often the devices with their coin acceptance arrangement cannot be locked, so that unauthorised access to the device through manipulation is possible.

A further problem is that unintentionally or intentionally liquids can be filled into the machine. These liquids can compromise mechanical or electronic parts of the machine or even destroy these. A similar problem is the insertion of foreign particles into the machine.

SUMMARY OF THE INVENTION

A device for accepting coins includes a holding fixture comprising a drawer that slides from an open configuration to a closed configuration. The holding fixture includes a coin insertion slot for receiving individual coins when the drawer is in the open configuration and when the drawer is in the closed configuration. The holding fixture includes a coin opening for receiving multiple coins when the drawer is in the open configuration. Sliding the holding fixture from the closed configuration to the open configuration enables multiple coins to simultaneously enter the holding fixture and also allows individual coins to enter the holding fixture through the coin insertion slot.

The holding fixture includes rails to enable the holding fixture to slide. Preferably the rails are slide-out rails. The holding fixture includes a side with a handle and a lock mounted on the side. The coin insertion slot mounts on the side.

The holding fixture includes a coin outlet area having at least one filter which separates coins and other objects. The coin outlet area having a fixed part and a moveable part, the moveable part being moveable to incline with respect to the fixed part, which allows coins to slide down the moveable part.

In one embodiment of the present invention, the moveable part rotatably mounts on the fixed part. The moveable part includes a guide wheel and the holding fixture includes a guide. The guide wheel and the guide cooperate to regulate movement of the coin outlet area to support the moveable part and enable coins to slide on the moveable part when the moveable part inclines with respect to the fixed part.

In one embodiment, the holding fixture includes a second filter to drain liquids, a controller, and a sensor, the sensor detects liquid and signals the controller when liquid is detected, the controller releases a corresponding warning in response to liquid detection by the sensor. The holding fixture includes a particle sensor in communication with the controller. The particle sensor detects objects, which are not coins, and communicates with the controller to generate a service notification.

The present invention includes a device for accepting of coins, which allows the acceptance of individual coins as well as the acceptance of various coins for the further processing of the coins via a coin outlet. The device includes a laterally moveable holding fixture mounted on rails. The holding fixture has a side, the side has a both a coin insertion slot, and a receptacle area for the reception of a plurality of coins.

The individual coins can therefore be easily inserted through the coin insertion slot and a plurality of coins can be simultaneously put or poured into the holding fixture.

Furthermore it is advantageous, if the front side with the coin insertion slot is also accessible if the holding fixture is in a closed position. This allows the use of small number of coins without opening the device.

It is thereby very advantageous, if the holding fixture is designed in a laterally moveable manner with pull-out rails. This also ensures safe functionality even with highly loaded holding fixtures. According to a preferred embodiment the holding fixture is moveable horizontally, sliding in a direction that is 90° from a vertical axis of the holding fixture.

The filter enables operation of the device when objects other than coins, are inserted into the holding fixture. The filter sorts the foreign objects, which are not coins, after the acceptance so that these do not get into the coin channel. Liquids are also filtered and directed to a liquid outlet of the holding fixture. Multiple filters can be used.

It is furthermore practical, if the filter is inclined to direct coins towards the tray bottom so as to guarantee a flawless coin outlet. By doing so, with a simple design an advantage is created regarding the transport of coins.

BRIEF DESCRIPTION OF THE DRAWINGS

The invention will be further described below with reference to exemplary embodiments illustrated in the drawings, but to which the invention is not limited. They show.

DETAILED DESCRIPTION

Figure 1:
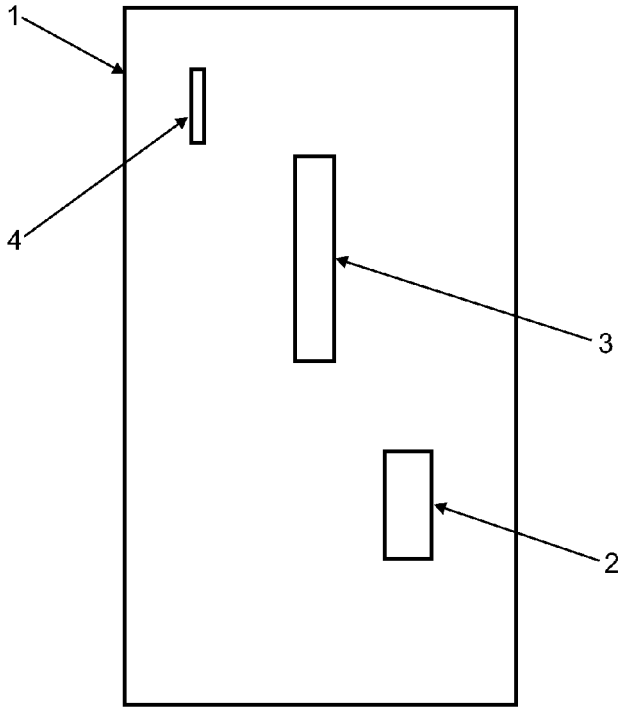
FIG. 1 is a front view of the holding fixture of the present invention.

FIG. 1 shows the face of a holding fixture 1 for receiving individual coins or for a plurality of coins. The holding fixture 1 includes a lock 2, an insertion slot 4 for inserting individual coins, and a handle 3 to enable an operator to slide the holding fixture 1 from an open configuration to a closed configuration. Coins should be broadly understood to include tokens, square coins, chips etc.

The holding fixture 1 is preferably a drawer. The holding fixture can be at least pulled out from any device including the holding fixture, by an operator. FIG. 1 thus shows a laterally extractable drawer in a frontal view, viewed from the operator's point of view.

In one embodiment, for protection against theft or for the protection against vandalism or destruction, the holding fixture is secured in its closed configuration with at least one lock 2. The lock 2 holds the holding fixture in its closed configuration and thus prevents unauthorised access to the holding fixture.

For example, with a closed drawer, holding fixture 1 operation is summarized as follows: when using the coin acceptance for large coin quantities it may be advantageous to have security guards of a financial institution or of an amusement arcade to open the drawer or the holding fixture manually with a key. Also, an electronically controlled opening of the security measures may be possible. Alternatively, individual operators may be equipped with a key, as on principle it can be assumed that the operators themselves appreciate a safe functioning of the device and would not endanger it.

The device is designed in such a manner that the application of a lock 2 is optional. According to the application a lock 2 may be provided or not. On principle this allows the usage without security guards, if it is desired.

The handle 3 opens the front side of the holding fixture 1. The handle 3 may be fixed horizontally or vertically at the front side of the holding fixture 1. The front side comprises a cover plate and this blocks the access to the inside of the holding fixture 1 when the holding fixture 1 is in the closed configuration.

The insertion slot 4 receives individual coins. The insertion slot 4 is designed in such a manner so that advantageously only coins intended for such purpose can be inserted into the device. It may be either directly connected to a channel for coins or as presented in FIG. 2 the insertion slot 4 may drop coins into the holding fixture 1 without an insertion slot. In such an event the coins inserted through the insertion slot 1 would fall directly into the tray situated in the holding fixture, below the insertion slot. Optionally the insertion slot is located on the front side of the holding fixture and allows the coin insertion when the holding fixture is in the open configuration, and when the holding fixture is in the closed configuration.

Figure 2:
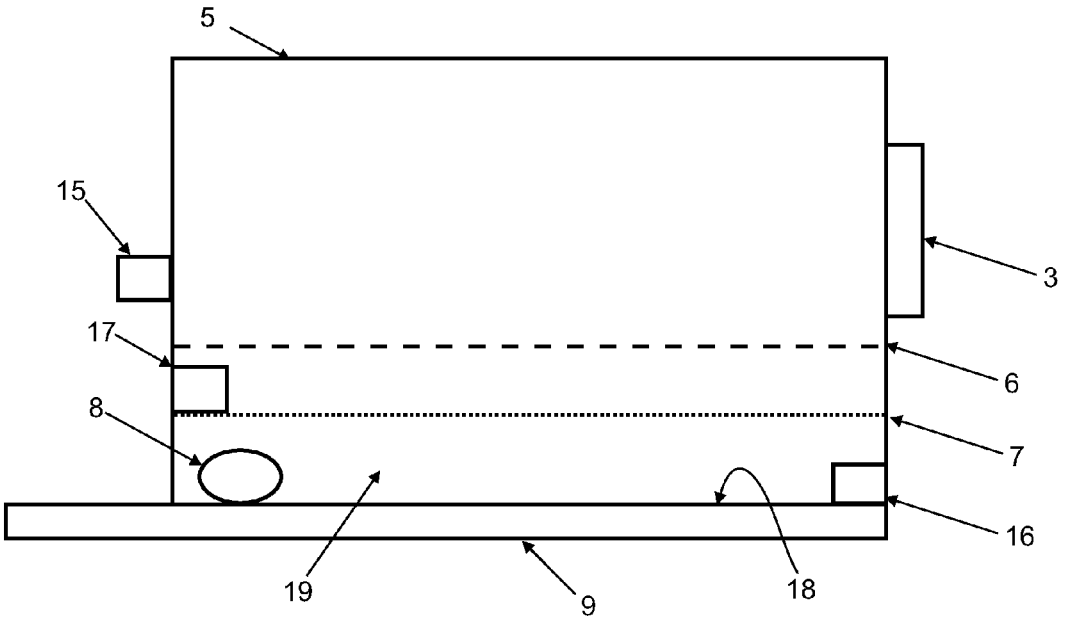
FIG. 2 is a lateral view of the holding fixture.

FIG. 2 shows a side view of the holding fixture of FIG. 1. The holding fixture comprises a drawer 5. The drawer 5 includes filter 6 and filter 7 for separating coins and other objects. The drawer 5 has an interior and the filters 6 and 7 mount in the interior of the drawer. The filters protect any device using the holding fixture from unserviceable objects.

The filter 6 is coarser than the filter 7 and is positioned above the filter 7, which is relatively finer.

The filter 7, which is situated below the coarser filter 6, ensures that at least liquids can be drained off. These are then drained off through a liquid outlet 8. The liquid outlet may be created with a tube, which leads to a bigger container and there allows the collection of liquid.

The area below the coarse grained filter 6 is designed as a tray 19 with a bottom 18 and with side panels.

Advantageously below the finer filter 7, a humidity sensor 16 is installed in the drawer 5. The humidity sensor is connected with a central controller 41.

This humidity sensor 16 signals the controller 41 of the system regarding the penetration of humidity and actuates the corresponding actions. These may range from, for example, warning notices on the screen 42 to the shut-down of the system in order to protect the system.

The humidity sensor 16 is conveniently installed in such a manner that it facilitates an easy wiring with the central controller 41. The foreign object sensor 17 (see FIG. 4) is installed in a similar manner. It sends service notices that foreign objects have been detected. Also, alternatively a diversion of the foreign object into a counterfeit money channel, which is not shown, is possible.

A micro switch 15 or similar device ensures the activation of the electronic system and the mechanical system 43 for the further processing of coins. The micro switch may be installed on the front or rear side, as in FIG. 2, of the drawer.

Figure 3A:
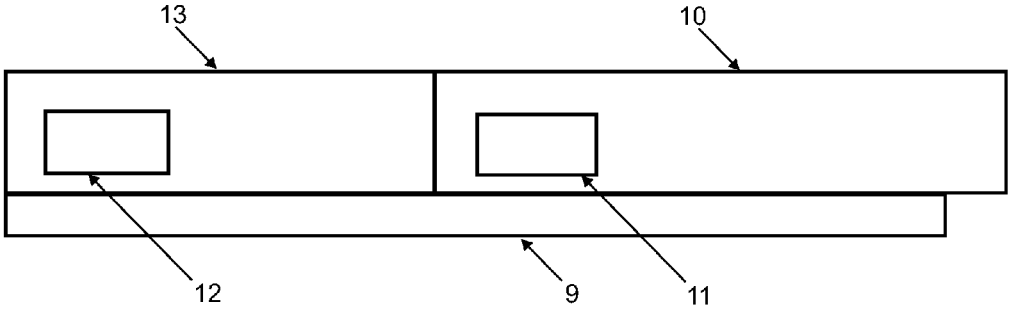
FIG. 3*a* and FIG. 3*b* show a processing mechanism.
Figure 3B:
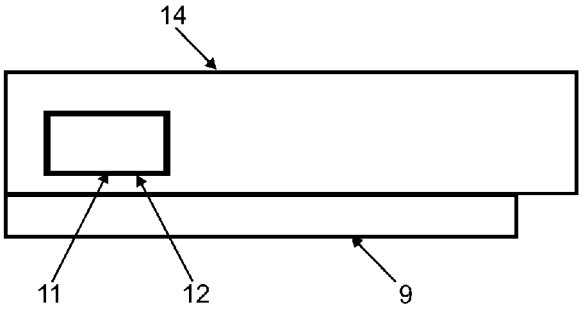

FIG. 3*a* shows the drawer open. FIG. 3*b* shows the drawer closed. The drawer is connected to a sliding rail. When the drawer is opened it is possible to insert the coins 52 through an insertion opening. The coins are then in a receptacle area, but cannot be skimmed or cannot be outlet through the opening 11. The opening 11 in the moveable part is covered by a part of the plate of the unmoveable part 13 of the drawer. Only if the moveable part of the drawer coincides 14, the coinciding openings 11 and 12 allow an outlet of the coins. Thereby it is prevented that more coins than can be contained in the drawer are fed in or that more coins than can be processed by the entire system are fed in.

Advantageously, the level of the filter 6 in FIG. 2 plays a supportive role. Therefore, the surface of filter 6 is not installed in a parallel manner to the tray bottom 18, but is in an inclined angle to the latter. Thereby the filter surface of the filter 6 is inclined and supports the outlet of the coins. This inclination is designed in such a manner so that a flawless outlet into the coin opening 12 is guaranteed and therefore no blockades of coins in the coin drawers are possible.

When the drawer 14 is open coins enter the insertion opening, and when the drawer 14 is closed the opening 12 coincides with the opening 11 to deliver coins via the opening 11 to a coin outlet area.

Figure 4:
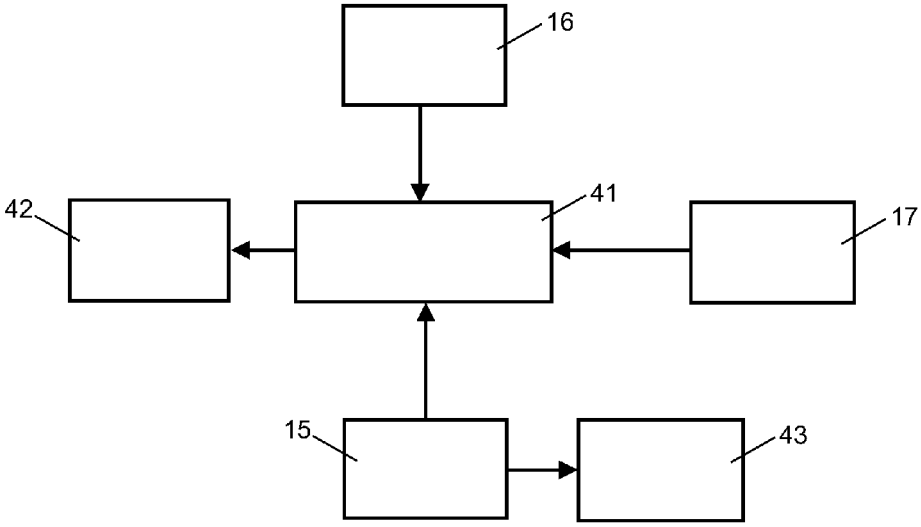
FIG. 4 is a system diagram of a controller.

FIG. 4 shows a controller 41 in operative communication with a humidity sensor 16, a particle sensor 17, a micro switch 15, processing electronics and mechanics 43, and a screen 42. The controller 41 communicates with the sensor 16 and the sensor 17 and the switch 15, and the processing electronics and mechanics 43 to regulate operation of the holding fixture 1. The controller 41 communicates messages to the screen 42.

Figure 5A:
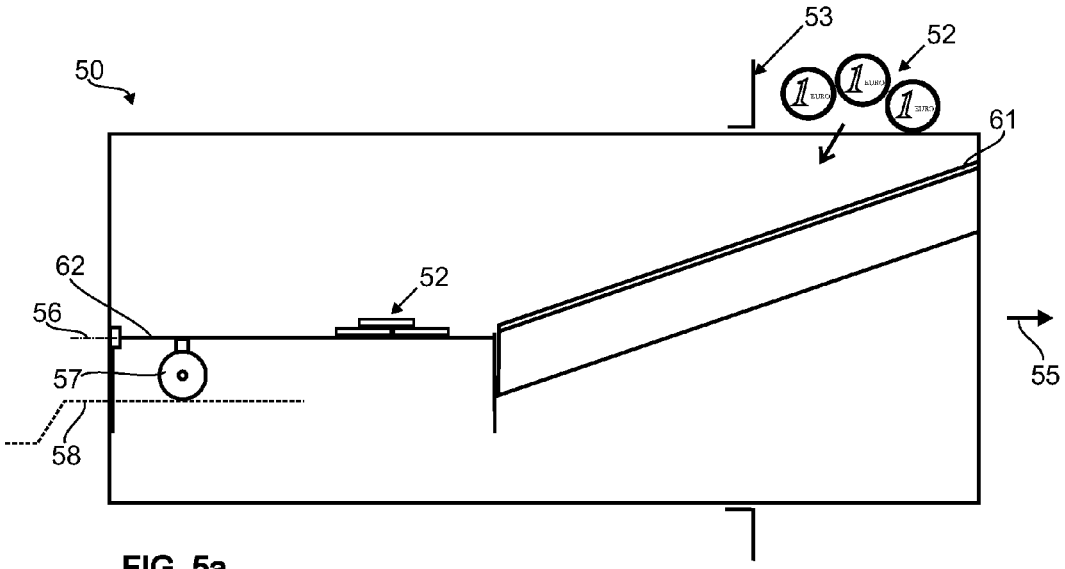
FIGS. 5*a* and 5*b* shows movement of the holding fixture.
Figure 5B:
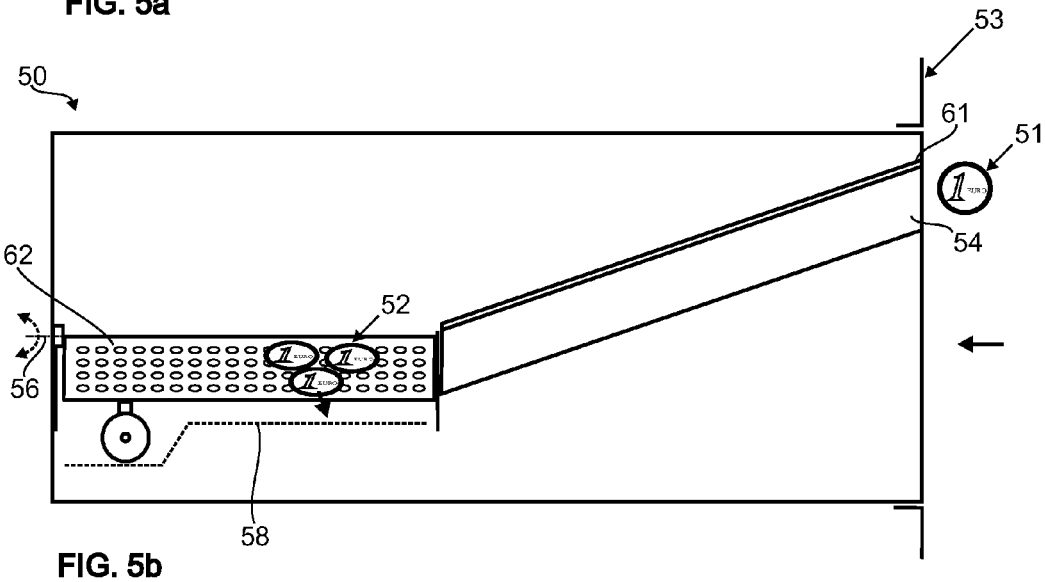
Figure 6:
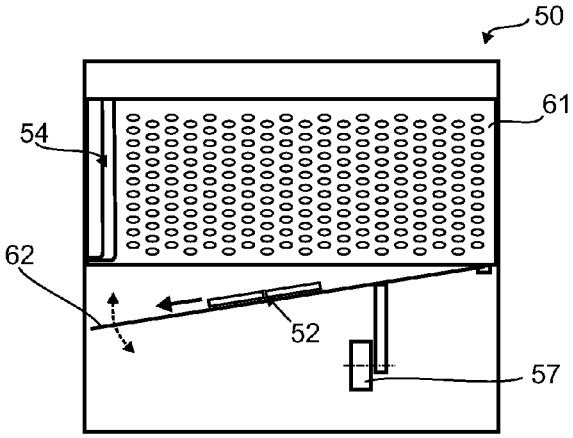
FIG. 6 shows an end view of the holding fixture of FIG. 5*b*.

FIG. 5*a*, FIG. 5*b* and FIG. 6 show a further embodiment of the device in accordance with the invention with a mounting fixture 50 for receiving individual coins 51 or for a plurality of coins 52.

FIG. 6 shows schematically (in pull-out direction) the laterally sliding drawer from FIG. 5*a* and FIG. 5*b* in a front view without the front cover.

The mounting fixture 50 is thereby designed as a drawer or a, laterally sliding mounting fixture, which may be at least partially pulled out by an operator of a (schematically shown) housing 53 of a coin changer, as is shown schematically in FIG. 5*a*. Furthermore the mounting fixture 50 has a coin channel 54 through which individual coins inserted in the slot 4 can be transported.

The mounting fixture 50 shows furthermore a coin outlet area which also, as described in connection with FIG. 2, has an inclination for the support of the gravitational transport of the coins 51, 52.

In this particular case the coin outlet area has an unmoveable (fixed) part 61 in relation to the drawer and a moveable part 62. The moveable part 62 is thereby designed and arranged around an axis 56 parallel to the direction of movement 55 of the drawer, so that the unmoveable part 61 is connected directly with a lower end to it. The unmoveable part 61 is overall installed in an inclined angle so that the gravitational transport of coins 52 inserted into the drawer is possible.

The moveable part 62 is coupled with a guide wheel 57, this guide wheel 57 follows the guide 58. In this particular case the guide wheel 57 follows the guide 58 gravitationally by the weight of the moveable part 62. The guide 58 is designed and arranged in such a manner that with an opened drawer the moveable part 62 is basically put into a horizontal position (see FIG. 5*a*) and with a closed drawer it is basically put into an inclined position (see FIG. 5*b* and FIG. 6). It may be mentioned that the moving of the moveable part can also be undertaken with the help of an electro-mechanical motor, whereby a controller device is provided which can controller the electro-mechanic motor in such a manner that the moveable part 62 is either put into a horizontal or inclined position.

In an opened drawer position coins 52 inserted into the drawer through the unmoveable part 61, initially come to lay in the moveable part 62 brought into the horizontal position. With a closed drawer the moveable part 62 is in an inclined position, so that a sliding of the coins into a further (here not shown) channel for sorting and counting or processing is possible.

In a further embodiment an automatic blocking or locking of the drawer during the processing of coins without the usage of a lock 2 for the locking of the drawer may be foreseen. Counting commences with a slid-in drawer and may be carried out so long until there are no more coins detected in the counting or sorting unit. During this time the drawer is locked and cannot be pulled out. By doing so, an overrun of the counting and sorting unit by all the time opening, filling and closing of the coin drawer is prevented. Therefore the filling level of the counting or sorting unit is determined with a filling level sensor and a filling level signal is given. Depending on the filling level an electro-mechanical bar is locked or opened. This electro-mechanical latch can be, for example, in operative connection with the rear part of the drawer. The electro-mechanical latch may have an angle for the locking. The locking may be designed and installed in the drawer in such a manner so that the coin drawer may be partially opened.

If the counting procedure is completed the counting unit stops and the locking is freed so that the next lot of coins may be filled in. The operator may require that the drawer can be pulled out again. This notification may occur acoustically through a voice response or a sound and/or through a notification on the operator screen 42.

It may also be foreseen that a particular amount of time (Time Out) is awaited after the last completed counting procedure until the inserted and already sorted coins are changed. The coin drawer may be locked in the interim until the payback is completed.

We claim:

1. A device for accepting coins, comprising:

a holding fixture comprising a drawer and slide-out rails, the slide-out rails enable the drawer to slide between an open configuration and a closed configuration;

the holding fixture includes a coin insertion slot for receiving coins when the drawer is in the open configuration and when the drawer is in the closed configuration, the width of the coin insertion slot being configured to receive individual coins; and the holding fixture has a side, the coin insertion slot is affixed on the side;

the holding fixture includes a coin opening for simultaneously receiving multiple coins when the drawer is in the open configuration, at least one coin outlet area having an outlet opening, the coin outlet area has a fixed part and a moveable part, the moveable part being moveable to incline with respect to the fixed part;

sliding the holding fixture from the open configuration to the closed configuration enables coins received by the holding fixture to move out through the outlet opening;

the fixed part has a lower part, and the moveable part being arranged on the lower part of the fixed part to swivel with respect to the fixed part; and the moveable part includes a guide wheel, the holding fixture includes a guide, the guide wheel and the guide cooperate to support the moveable part and enable coins to slide on the moveable part when the moveable part inclines.

2. The device in as set forth in claim 1 further comprising: a filter to drain liquids.

3. The device as set forth in claim 1 further comprising: a sensor, the sensor detects liquid.

4. The device as set forth in claim 3 further comprising:

a controller in communication with the sensor;

the sensor signals the controller when liquid is detected;

the controller releases a warning in response to liquid detection by the sensor.

5. The device as set forth in claim 4 further comprising:

a particle sensor in communication with the controller, the particle sensor detects objects, which are not coins, and communicates with the controller to generate a service notification.

6. The device as set forth in claim 5, wherein the holding fixture has a rear portion and an electro-mechanical latch attaches to the rear portion of the holding fixture.

7. The device as set forth in claim 6, further comprising a sensor for detecting the filling level of the holding fixture, and an electro-mechanical bar, whereby depending on the filling level the electro-mechanical bar is locked or opened.

8. A device for accepting coins, comprising:

sliding rails;

a holding fixture mounted on the sliding rails, the holding fixture able to slide from an open configuration to a closed configuration;

the holding fixture includes a coin insertion slot sized for receiving individual coins, the coin insertion slot being accessible when the drawer is in the open configuration and when the drawer is in the closed configuration;

the holding fixture includes a drawer and a coin opening for simultaneously receiving multiple coins when the drawer is in the open configuration;

a coin outlet area having a fixed part and a moveable part attached to the fixed part, the moveable part pivots with respect to the fixed part to release coins;

the moveable part includes a counting unit with a sensor for detecting a filling level of the counting unit; and an electro-mechanical bar that locks or opens depending on the filling level, wherein sliding the holding fixture from the open configuration to the closed configuration enables multiple coins to simultaneously enter the device.

9. The device as set forth in claim 8, wherein the holding fixture has a lock mounted on the side.

10. The device as set forth in claim 8, wherein the electro-mechanical bar includes an electro-mechanical latch connected to the holding fixture.

11. The device as set forth in claim 10, wherein the holding fixture has a rear portion and the electro-mechanical latch attaches to the rear portion of the holding fixture.

12. The device as set forth in claim 11, wherein the electro-mechanical latch has an angle.

13. The device as set forth in claim 12, wherein the electro-mechanical latch enables the coin drawer to be partially opened.

14. A device for accepting coins, comprising:

sliding rails;

a drawer mounted on the sliding rails, the drawer being able to slide from an open configuration to a closed configuration;

the drawer includes a coin insertion slot for receiving individual coins, the coin insertion slot being accessible when the drawer is in the open configuration and when the drawer is in the closed configuration;

an electro-mechanical latch attachable to the drawer;

the drawer includes a coin opening for simultaneously receiving multiple coins when the drawer is in the open configuration; and a coin outlet area having a fixed part and a moveable part attached to the fixed part, the moveable part pivots with respect to the fixed part to release coins, the moveable part includes a counting unit with a sensor for detecting a filling level of the counting unit; and an electro-mechanical bar, whereby depending on the filling level the electro-mechanical bar is locked or opened, wherein when the drawer slides from the open configuration to the closed configuration it enables multiple coins to simultaneously enter the device.

* * * * *